United States Patent [19]

Wiley

[11] Patent Number: 4,736,942

[45] Date of Patent: Apr. 12, 1988

[54] APPARATUS FOR SEPARATING MOVING SUPERPOSED FABRIC LAYERS

[75] Inventor: Thomas W. Wiley, Asheville, N.C.

[73] Assignee: Tex-nology Systems, Inc., Arden, N.C.

[21] Appl. No.: 908,262

[22] Filed: Sep. 17, 1986

[51] Int. Cl.[4] ..... B65H 29/32

[52] U.S. Cl. ..... 271/284; 271/195; 271/310

[58] Field of Search ..... 271/283, 284, 309, 310, 271/195, 196, 280

[56] References Cited

U.S. PATENT DOCUMENTS

| | | | |
|---|---|---|---|
| 3,243,181 | 3/1966 | Lyman | 271/195 X |
| 3,268,222 | 8/1966 | Off | 271/195 |
| 3,844,189 | 10/1974 | Jardine | 271/195 X |

FOREIGN PATENT DOCUMENTS

| | | | |
|---|---|---|---|
| 134502 | 3/1960 | U.S.S.R. | 271/284 |

*Primary Examiner*—Richard A. Schacher

*Attorney, Agent, or Firm*—Luedeka Hodges & Neely

[57] ABSTRACT

Apparatus for separating moving superposed fabric layers includes structure defining upper and lower spaced-apart, opposed surfaces between which the superposed fabric layers are conveyed. Provision is made for directing jets of gaseous fluid along the surfaces generally in the direction of movement of the superposed fabric layers. Portions of the surfaces diverge away from the layers and from the direction in which the jets are moving, and are located downstream of the locations from which the jets issue. As a result, a vacuum is created between the superposed fabric layers and the upper and lower surfaces adjacent the diverging portions thereof causing the layers to separate. Because of their direction, the jets also impart a forward force on the separated fabric layers generally in the direction of movement of the fabric preventing the fabric from flapping, curling or bunching up between the plates during separation. A guide is provided adjacent the point of separation to maintain the layers in a separated condition.

9 Claims, 4 Drawing Sheets

APPARATUS FOR SEPARATING MOVING SUPERPOSED FABRIC LAYERS

The present invention relates to fabric separation apparatus and more particularly relates to an apparatus for separating moving fabric layers that are superposed one on top of the other to facilitate, for example, insertion of material between the layers.

There are many circumstances in textile manufacturing where it is desirable to process fabric layers in a folded over or superposed condition. This would be the case, for example, where the ultimate product is a fabric enclosure of some type having attached upper and lower fabric layers or panels such as pillow tick textile products. In the production of these latter products, it is often desired to incorporate bound piping around the edges. Heretofore, pillow tick products incorporating bound piping have ordinarily been produced by hand manipulation due to the absence of a suitable means for separating the superposed fabric layers in a continuous, automated process to permit insertion of the piping. In large part, the absence of such separation means for superposed fabric layers has been due to the fact that fabric is ordinarily relatively limp compared with other materials such as metal or paper and does not lend itself well to manipulation by way of separation from a superposed condition using known automatic separation techniques.

Accordingly, it is an object of the present invention to provide an apparatus for continuously and automatically separating moving superposed fabric layers so that material can be inserted between the layers.

It is another object of the present invention to provide an apparatus of the character described which is capable of separating a pair of moving fabric layers which are superposed on each other with their leading edges in substantial alignment wherein the leading edges of the layers are separated and the separation is maintained during insertion of material between the layers.

It is a further object of the present invention to provide an apparatus of the character described which reduces the labor required to produce textile products incorporating bound piping and the like between fabric layers.

Another object of the invention is the provision of an apparatus for separating moving fabric layers wherein the layers consist of superposed pairs of layers of substantially equal proportions and relatively short lengths, the pairs of layers being conveyed flat and spaced-apart from adjacent pairs of layers.

It is still another object of the present invention to provide an apparatus for separating moving superposed fabric layers which is simple to operate and control and which effectively separates the fabric layers in a desired manner.

These and other objects and advantages of the present invention will become apparent upon an understanding of the following detailed description when considered in conjunction with the accompanying drawings in which.

Figure 1:
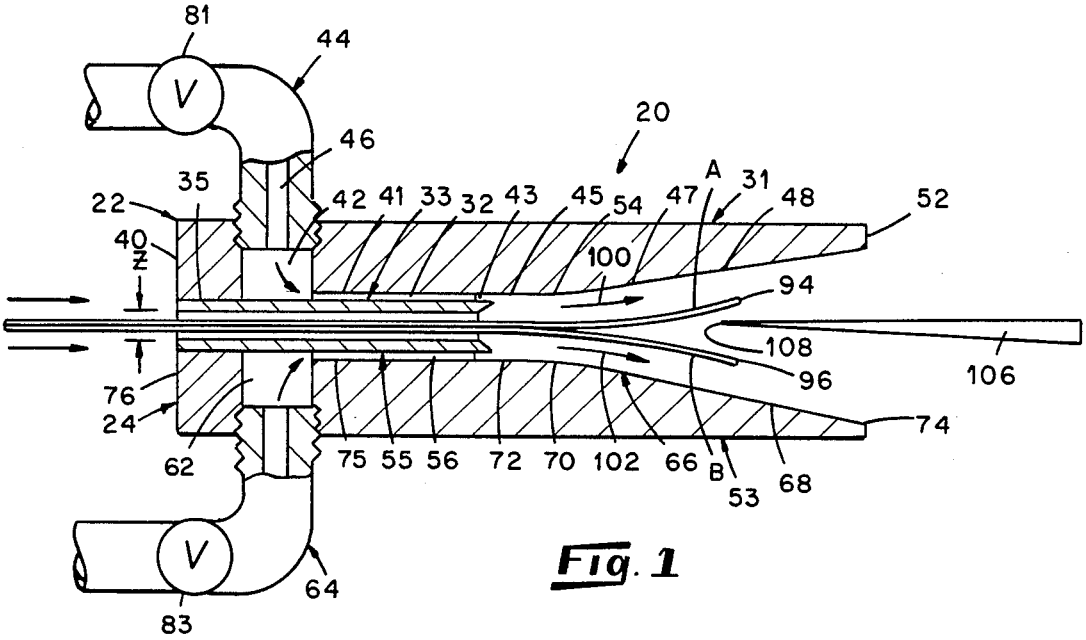
FIG. 1 is a side elevational view, partially in section, of an apparatus for separating fabric layers according to a preferred form of the present invention.

The present invention is especially adapted for use in a textile manufacturing process wherein superposed fabric layers are conveyed with a first layer thereof superposed on a second layer. The first and second fabric layers have leading edges that are substantially aligned, which alignment may arise, for example, by cutting the fabric layers across their width to define longitudinally spaced-apart double layers of fabric of substantially equal longitudinal proportions.

In general, the invention includes structure defining spaced-apart, opposed first and second surfaces disposed to face the first and second layers of fabric, respectively. Provision is made for supporting and maintaining the first and second surfaces at predetermined operative dispositions adjacent the first and second layers, respectively, so that the layers are conveyed between the first and second surfaces. Means are provided for creating a vacuum between the first and second surfaces and the first and second layers, respectively, of the superposed layers so that the layers are spearated at their leading edges as they are conveyed between the first and second surfaces. The vacuum means is also configured to impart a force on the moving superposed layers as they are conveyed between the first and second surfaces so that the layers are urged and translated generally in the direction in which they are being conveyed.

Referring now to the drawings in which like reference characters refer to like or similar parts throughout the several views, various features of a preferred embodiment of an apparatus 20 for separating moving superposed fabric layers are shown in FIGS. 1–6.

Figure 2:
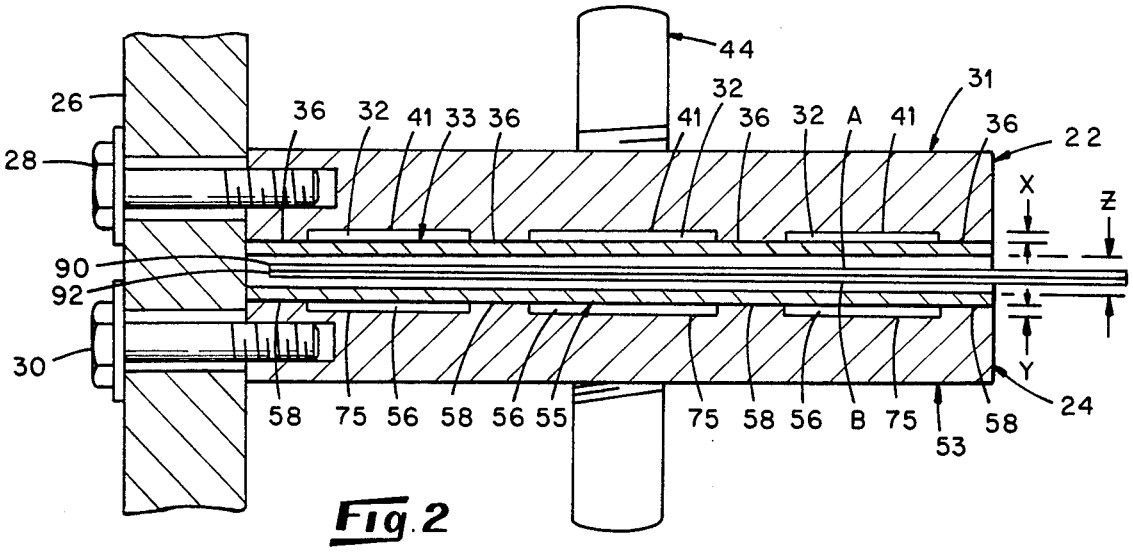
FIG. 2 is a front elevational view, partially in section, of the apparatus of FIG. 1.

Initially with reference to FIGS. 1 and 2, the apparatus 20 includes opposed blocks 22 and 24 adjustably supported in a spaced-apart relationship on a brace 26 through the use of bolts 28 and 30. The blocks 22 and 24 are configured to define opposed first and second surfaces of the apparatus 20 disposed to face upper and lower surfaces, respectively, of a pair of superposed fabric layers A and B. Means such as moving upper and lower arrangements of laterally spaced apart belt strips (not shown) may be employed for supporting and conveying the layers in a superposed condition confined between the upper and lower belt arrangements. Preferably, the edges of the layers A and B are permitted to extend laterally outwardly of the belt strips and are conveyed between the blocks 22 and 24 as shown in FIG. 2. For the purpose of convenience, the block 22 will be referred to hereinafter as the upper block 22 and the block 24 will be referred to hereinafter as the lower block 24, it being understood that the blocks 22 and 24 may be disposed in a number of different arrangements depending on design requirements such as having the blocks 22 and 24 project vertically or at some intermediate angle relative to horizontal. For example, it may be desirable to perform the separation with the portion of the fabric being separated disposed to hang vertically relative to the remainder of the fabric.

Features of the preferred form of the upper block 22 will now be described with reference to FIGS. 1 through 5. The block 22 includes a base portion 31 and a fabric guide plate 33 attached to a lower surface 35 of the base. As best seen in FIG. 2, a plurality of channels 32 are formed in the lower surface 35 of the base 31 for issuing jets of gaseous fluid, preferably air, in a manner to be described. Each channel 32 preferably has the same depth denoted by the symbol "X" shown to the right-hand side of the upper block 22 in FIG. 2 and may be rectangular in cross-section as shown. The channels 32 are separated by lands 36 formed in the base 31.

The fabric guide plate 33 is diposed on the lower surface 35 of the base 31 to cover the channels 32 and extends from substantially flush with a front side 40 of the base 31 across the width of the base 31 and terminates a predetermined distance beyond the ends of the lands 36. Upper planar surfaces 41 of the channels 32 extend beyond exit openings 43 of the channels adjacent the ends of the lands 36, and after exiting the channels 32, merge together to form a ledge 45. The ledge 45 extends generally across the width of the base 31 and is subtantially coplanar and continuous with the upper surfaces 41 so that the flow pattern of air moving along the upper surfaces 41 is not disrupted when the air reaches the ledge 45.

The base 31 is provided with a plenum 42 which communicates with the channels 32 and is enclosed by the plate 33 as shown in FIG. 1. A fitting 44 is threadably received into the plenum 42 from above the base 31 and includes a passageway 46 in communication with the plenum 42. The fitting 44 is connected to a source of compressed air (not shown) so as to deliver the air to the plenum 42 and into the channels 32.

The upper block 22 defines a downwardly facing surface 47 across its bottom which includes a sloping face 48 on the base 31 that proceeds rearwardly in an upwardly inclined manner from adjacent the ledge 45 to a back side edge 52 of the base 31, and extends across the width of the base 31. A flow transition area 54 between the sloping face 48 and ledge 45 is preferably configured in the form of a smooth rounded corner extending across the width of the base 31. The downwardly facing surface 47 of the block 22 therefore includes, in the illustrated embodiment, the outer surface of the plate 33, the ledge 45, the transition area 54, and the sloping face 48, all of which face the upper surface of the superposed layers A and B.

The lower block 24 is preferably configured substantially identically to the upper block 22 and therefore includes a base portion 53 and fabric guide plate 55 attached to an upper surface 57 of the base 53. A plurality of channels 56 are defined in the upper surface 57 of the base 53 between lands 58 so that the channels 56 have a dpeth denoted by the symbol "Y" shown to the right of the lower block 24 in FIG. 2. The depth "Y" of the channels 56 is preferably substantially equal to the depth "X" of the channels 32 in the upper block 22.

The fabric guide plate 55 is disposed on the lands 58 to cover the channels 56 and a plenum 62, adjacent which the base 53 threadably receives a fitting 64 for delivering compressed air to the plenum 62 which conducts and distributes compressed air to the channels 56.

The lower block 24 includes an upwardly facing surface 66 configured substantially identically to the downwardly facing surface 47 of the upper block 22. Thus, a sloping face 68 of the base 53 proceeds rearwardly in a downwardly inclined manner to a back side edge 74 of the base 53 from a flow transition area 70. The back side edge 74 is located between a ledge 72 and the sloping face 68 and the ledge 72 extends from exit openings 73 of the channels 56. The surface of the ledge 72 is preferably coplanar and continuous with lower planar surfaces 75 of the channels 56 as in the case of the ledge 45 of the base 31 of the upper block 22. Again, as in the upper block 22, the plate 55 of the lower block 24 is substantially flush with a front side 76 of the base 31 of the lower block 24.

Figure 4:
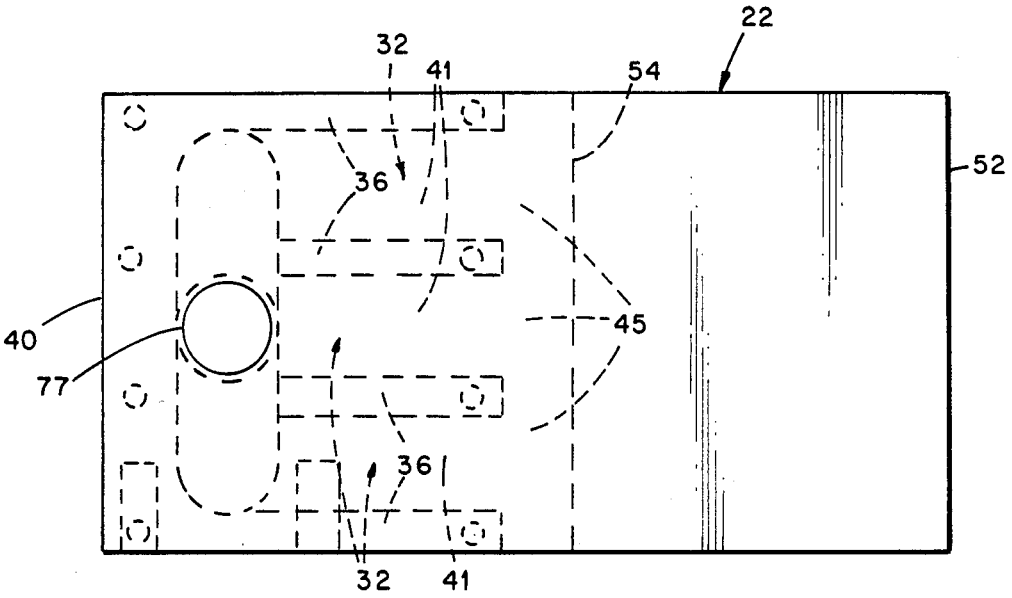
FIG. 4 is a plan view of a base portion of a block for use in the apparatus shown in FIG. 1.
Figure 5:
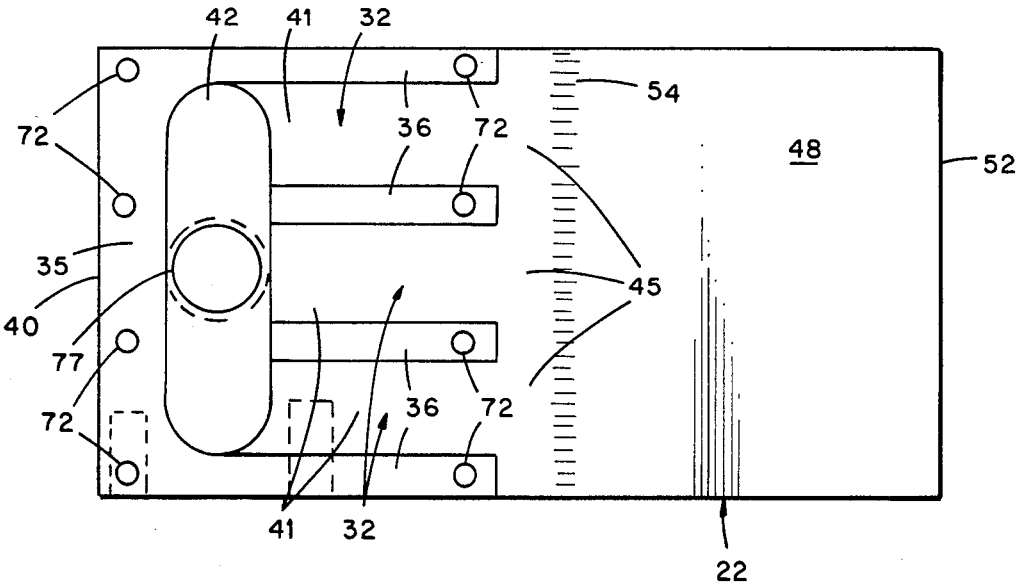
FIG. 5 is a bottom view of the base shown in FIG. 4.
Figure 6:
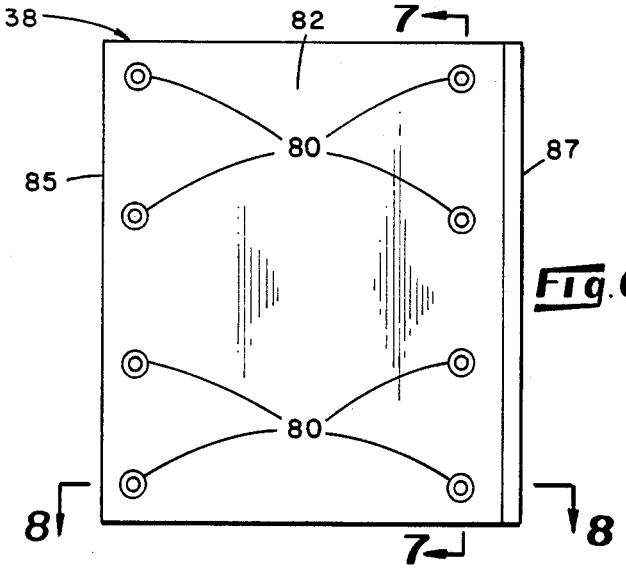
FIG. 6 is a top view of a fabric guide for covering a portion of the base shown in FIG. 4.
Figure 7:
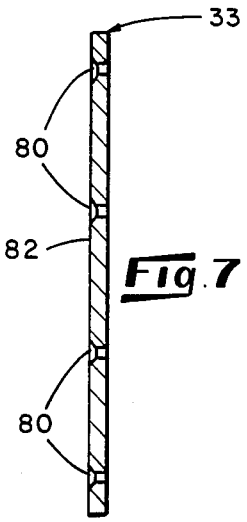
FIG. 7 is a view along line 7—7 of the guide shown in FIG. 6.
Figure 8:
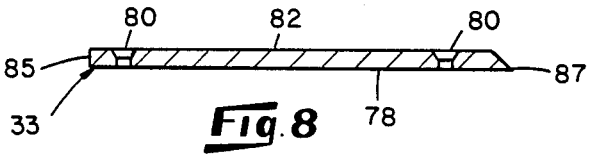
FIG. 8 is a view along line 8—8 of the guide shown in FIG. 6.

Referring now to FIGS. 4 and 5, the base 31 of the upper block 22 is viewed in plan from the top in FIG. 4 and from the bottom in FIG. 5. FIGS. 6 through 8 depict top, side and cross-sectional views of the fabric guide plate 33 of the block 22. The preferred dimensions of the upper block 22 will now be given for use in separating fabric layers of the type used in the manufacture of pillow tick products. It should be understood, however, that the dimensions may be altered according to design exigencies consistent with particular processing requirements or other fabric types so as to effect the optimum separation. Further, while the same dimensions preferably apply to the lower block 24, modifications thereof in relation to those of the upper block 22 for particular applications will be expected.

The length of the base 31 from its front side 40 to its back side edge 52 is about 5.25 in. and the width across the base 31 is approximately 3.0 in. At its thickest part; that is, between its upper surface and the lower surface of the lands 36, the base 31 is about 0.50 in. wide. At the back side edge 52 of the base 31, where the sloping face 48 terminates, the base 31 is about 0.125 in. thick, which thickness is preferably constant across the width of the base 31.

The channels 32 have a depth "X" of 0.010 to 0.015 in. preferably about 0.010 in. Of course, this translates into a height of the lands 36 of about 0.010 in. Thus, the thickness of the base 31 at the ledge 45 is approximately 0.49 in. This thickness of the base 31 exists through the channel areas and out to the transition area 54. The transition area 54 is spaced from the back side edge 52 of the base 31 about 2.625 in. The ultimate angle (see FIG. 3) of the sloping face 48 with the ledge 45 is preferably about 10.5°. Thus, the transition area 54 is positioned about 2.67 in. from the back side edge 52.

The individual lands 36 are about 0.188 in. wide and have a length of about 1.25 in. As is shown, the lower planar surfaces of the endmost lands 36 connect together along the lower surface 35 of the base 31. The surface 35 is continuous with the lower surfaces of the endmost lands 36 and is coplanar with all the lands 36 to facilitate attachment of the plate 33 to the base 31 in a substantially airtight manner as hereinafter described.

The plenum 42 is in the form of an elongate channel formed adjacent the front side 40 of the base 31 and has its left-hand edge as viewed in FIGS. 4 and 5 formed about 0.50 in. from the front side 40. The plenum 42 is approximately 0.375 in. wide and about 0.250 in. deep. The plenum 42 has rounded ends, each of which has a radius of about 0.1875 in. and the length of the plenum 42 from end to end is in the neighborhood of 2.75 in. A circular opening 77 extends from the top surface of the base 31 down into the plenum 42 and has a diameter of approximately 0.375 in. The opening 77 is formed with its center midway between the side edges of the base 31 and has its center substantially aligned with the longitudinal center of the plenum 42. The opening 77 is tapped to threadably receive the fitting 44 which is preferably an elbow-type fitting as shown.

A plurality of small openings 72 are formed in the surface 35 and in the lands 36 for use in attaching the plate 33 to the base 31. The openings 72 may be formed using a #33 drill bit and are threaded with a #6 tap to a 0.125 in. minimum depth. As is shown, the openings 72 adjacent the front side 40 are aligned and the openings 72 in the lands 36 are also aligned. The aligned openings 72 in the lands 36 are spaced forwardly of the aligned openings 72 in the surface 35 about 1.47 in. The openings 72 in the lands 36 are drilled on centers spaced from the edges of the lands 36 about 0.94 in. The openings 72 adjacent the front side 40 are drilled on centers spaced from the front side 40 about 0.25 in.

The fabric guide plate 33 shown in FIGS. 6 through 8 is approximately 3 in. across and 2.31 in. from its front edge 85 to its back edge 87. The back edge 87 is preferably a sharpened edge formed by making a cut across the width of the plate 33 at about a 26.6° angle with a planar bottom surface 78 of the plate 33. The plate 33 is approximately 0.125 in. thick which thickness is substantially constant throughout the plate 33 with the exception of the decreasing thickness adjacent the sharpened back edge 87.

A plurality of openings 80 are formed through the plate 33. The openings 80 are provided in the same number as the openings 72 in the base 31 and are spaced apart on the plate 33 so that their centers will be aligned with the centers of the openings 72 in the base 31 when the plate 33 is disposed on the base 31 as shown in FIGS. 1 and 2. The openings 80 may be formed using a 0.156 in. drill bit and countersunk for #6 flathead screws (not shown) configured to be threadably received by the openings 72 in the base 31. In this manner, the screws will reside with their heads flush with the lower surface 82 of the cover 33. If desired, a gasket or seal of some type may be provided between the plate 33 and the base 31.

The bases 31 and 53, and plates 33 and 55 of the upper and lower blocks 22 and 24 are preferably machined in the indicated configurations from blocks of stainless steel. Preferably, the surfaces exposed to air flow or fabric movement are polished to reduce friction.

Referring now to FIGS. 1–8 generally, the operation of the apparatus 20 will be described. The blocks 22 and 24 are set at some initial separation distance between the outer surfaces of the fabric guide plates 33 and 55 using the bolts 28 and 30. Air is admitted to the plenums 42 and 62 through the fittings 44 and 64 and regulated to desired initial flow rates initial flow rates through the use of needle valves 81 and 83, respectively.

Figure 3:
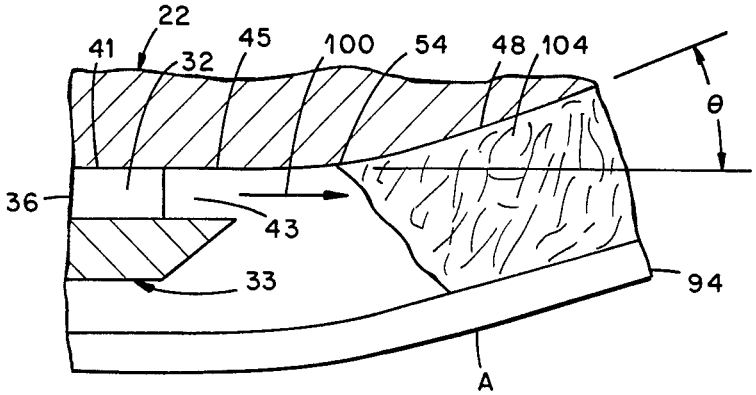
FIG. 3 is a somewhat diagrammatic view illustrating a portion of the apparatus shown in FIG. 1.

Air entering the plenums 42 and 62 is conducted through the channels 32 and 56 and issues out of the channels 32 and 56 along the ledges 45 and 72 toward the transition areas 54 and 70. The air flowing along the ledges 45 and 72 flows past the transition areas 54 and 70 which, as described above, are preferably provided by smooth rounded corners between the ledges 45 and 72 and the faces 48 and 68 which proceed outwardly, away from the air flow. The result is creation of low pressure zones adjacent the faces 48 and 68 which produces a vacuum between the downwardly and upwardly facing surfaces 47 and 66 of the upper and lower blocks 22 and 24 and the fabric layers A and B. This effect is illustrated in FIG. 3 in the case of the upper block 22. As can be seen, the air flowing as at 100 past the transition area 54 produces a low pressure zone indicated diagrammatically as the cross-hatched area 104 adjacent the sloping face 48 just behind the transition area 54, creating a vacuum between layer A and surface 47. The same effect is created on the lower block 24.

The preferred configuration of the channels 32 and 56 provides for high velocity air jets flowing past the transition areas 54 and 70 which jets are in the form of relatively thin sheets of air having a substantially uniform thickness and issuing along the ledges 45 and 72 in intimate contact therewith. In this manner, the jets are able to effect a separation of the layers A and B in very stable and maintainable flow patterns not subject to significant variations, so that the need for adjustment of the apparatus 20 during use is minimized.

The pair of superposed fabric layers A and B are conveyed and supported using suitable textile machinery (not shown) so that their side edges 90 and 92 extend freely for being guided between the blocks 22 and 24. Commonly, the layers A and B are further arranged so that their leading edges 94 and 96 across their width are substantially aligned upon entering the apparatus 20 and the layers A and B are in mutual contact along their interface. When the layers A and B are conveyed between the blocks 22 and 24, the edges 94 and 96 are presented adjacent the low pressure zones whereupon a vacuum condition arises between the fabric layers A and B and the upwardly and downwardly facing surfaces of the blocks 22 and 24, respectively, which separates the edges 94 and 96 as described. Optimum separation of the layers is dependent on a number of factors including the magnitude of the initial air flow rates, the type of fabric being conveyed, the speed of the fabric, and the initial separtion distance between the blocks 22 and 24. Another factor which influences the separation of the fabric layers is the positioning and configuration of a guide member 106 which represents a preferred means for maintaining the layers A and B in separated condition. The guide 106 is preferably configured with a leading edge 108 positioned just back of the point of separation so as to maintain the layers A and B apart, consistent with subsequent processing requirements. The guide 106 also is preferably formed having a tapered configuration narrowing towards the forward edge 108 as shown to minimize the creation of turbulence in the air moving around the guide 106. Other suitable means for maintaining the layers in a separated condition include, for example, the actual insertion of material between the layers A and B just after separation such as the insertion of piping therebetween. Of course, in this operation care must be taken not to impart undue disturbances to the flow of air that is occurring to effect the separation.

For a given fabric type and processing speed, optimum separation may be achieved by adjusting the flow rates, the positioning of the guide 106, and/or the separation distance between the blocks 22 and 24. More or less adjustment may be required depending on experience with the apparatus 20.

It should be noted that the flow pattern along the blocks 22 and 24 as shown and described also encourages forward movement of the layers A and B through the apparatus 20. That is, the streams of air engage the layers A and B and impart a force on the layers generally in the direction in which the layers are being conveyed. The initiation of this effect is thought to occur prior to separation of the leading edges 94 and 96 and the edges, upon being separated, are urged and translated in a forward direction by the force of the air flow. As more fabric is exposed to the air flow, the influence of the air on the fabric is increased until the leading edges 94 and 96 are moved adjacent to or just past the back edges 52 and 74 of the bases 31 and 53. Thus, although the fabric may be relatively limp or flimsy, it will not collapse together, ruffle, or a curl inwardly or outwardly at the leading edges 94 and 96 before the edge 94 of the upper fabric layer A reaches the upper surface of the guide 106. In this regard, it is further noted that once the upper fabric layer A has moved a small distance along the guide 106, the structural integrity of the fabric together with the air flow between the sloping face 48 and the layer A will serve to maintain the edge 94 in forward disposition and the layer A along its side edge 90 in a predominantly planar configuration.

An additional factor found to influence separation of the fabric layers and maintenance of the separation thereof is the presence or absence of flow disturbances downstream of the blocks 22 and 24. Optimum separation is achieved when the area behind the blocks 22 and 24 is free of flow obstructions so that the air exiting the apparatus 20 does so without significant deflection or restraint.

The considerations noted above with regard to the effect of the air flow in maintaining forward movement of the fabric layers also applies to the lower layer B, except that the leading edge 96 thereof is ordinarily directed to an auxiliary support of some suitable type positioned adjacent the back edge 76 of the lower block 24. Thus, the guide 106 does not come into play with regard to the lower layer B to the same degree as it does with regard to the leading edge 94 of the upper layer A when the fabric layers A and B are being separated while in a substantially horizontal disposition. Moreover, when the blocks 22 and 24 are disposed substantially horizontally, gravity forces come into play which must be overcome with regard to the upper layer A. However, these forces actually aid in effecting the separation with reagrd to the lower layer B. As a consequence, air flow out of the channels 56 in the lower block 24 may in some cases be maintained at a lower rate than the air flow out of the channels 32 in the upper block 22.

The apparatus 20 and method of the present invention make possible a number of new textile processing and manufacturing techniques. In particular, it is now possible to process superposed fabric layers in circumstances where it is desirable or necessary to continuously and automatically separate the layers at some stage of the manufacturing process. Heretofore, it was not thought feasible to process superposed fabric layers in this manner.

Figure 9:
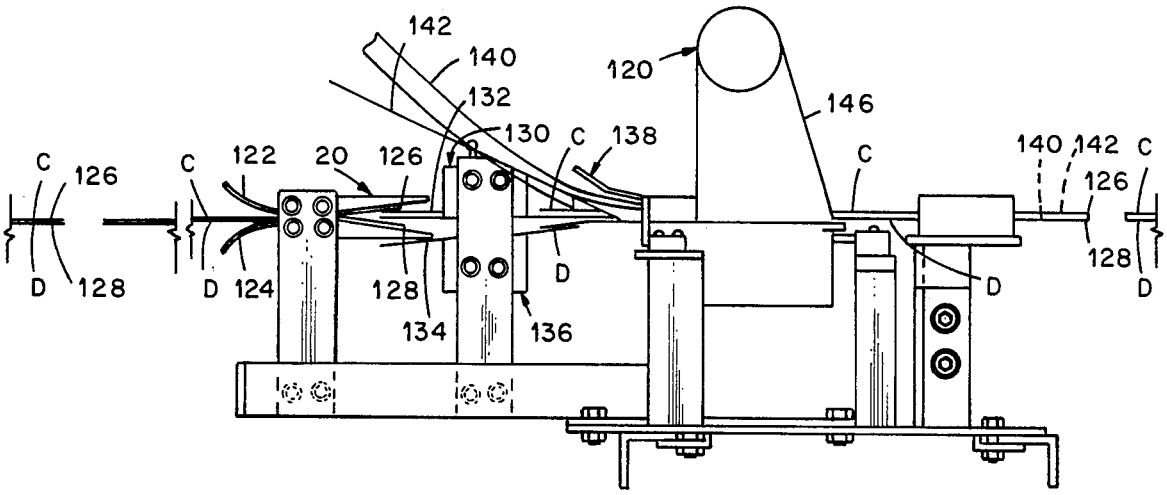
FIG. 9 is an elevational view illustrating incorporation of the apparatus of the present invention into a piping insertion/sewing station for the purpose of separating fabric layers between which the piping is to be inserted and sewn.
Figure 10:
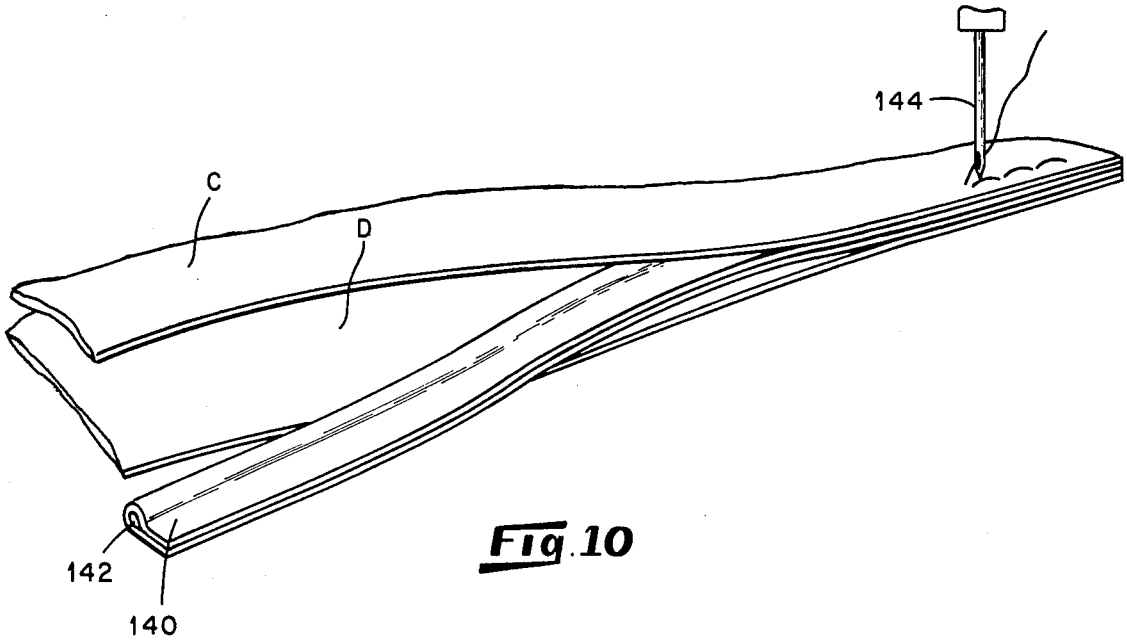
FIG. 10 is a diagrammatic view illustrating insertion of piping between the separated layers of fabric.

One technique made possible by the present invention is illustrated in FIGS. 9 and 10 and involves continuous, automatic insertion/sewing of piping between two fabric panels C and D which may be panels for use in constructing a pillow tick product. The panels C and D are overlaid one on top of the other with their side edges and leading and trailing edges in substantial alignment. This arrangement would be produced, for example, by folding a larger fabric layer over on itself longitudinally along its center and then cutting the layer along the fold line. The individual separate panels C and D would then be produced when the folded over layer is cut across its width at predetermined intervals.

The panels C and D may then be conveyed through a piping insertion/sewing station 120 by capturing the panels C and D in a planar configuration between spaced-apart moving belts (not shown) configured to permit the side edges of the panels C and D to project laterally as they approach the station 120.

The apparatus 20 is positioned ahead of the station 120 as shown and, for the purpose of guiding the edges of the panels C and D into the operative portion of the apparatus 20, may include diverging upper and lower curved guides 122 and 124, respectively, at the entrance of the panels C and D into the apparatus 20. As described above, the apparatus 20 effects a separation of the panels C and D at their leading edges indicated at 126 and 128 in FIG. 9. The guide 106 illustrated and described above with reference to FIGS. 1 through 3 is incorporated into the apparatus 20 in the form of an upper guide member 130 which may include an inwardly projecting plate 132, the front end of which functions as the guide 106. Thus, the leading edge 126 moves onto the plate 132 and is guided toward the station 120 on the plate 132. The leading edge 128 of the other panel D moves onto a plate 134 of a lower guide member 136.

Both panels C and D are conveyed over the plate 132 and 134 in a separated configuration and move into the area of a piping forming assembly 138 which forms a length of tape 140 around a cord 142 and feeds the thusly formed tape 140 and cord 142 to a vertically reciprocating needle 144 of a sewing machine 146. This part of the operation is illustrated diagrammatically in FIG. 10 wherein the panels C and D are allowed to converge ahead of the needle 144 with the tape 140 and cord 142 between the side edges as shown. (The sewing machine 146 also includes a presser foot assembly at the location of the needle 144 which is omitted for clarity.)

The panels C and D exit the station 120 with the piping bound between their side edges. When processing of the panels C and D is complete; that is, when piping has been sewn between all the side edges, a pillow tick product is formed which is then turned inside out to expose the smooth rounded edge of the piping, and the seam is invisible from the outside of the tick.

The above process is exemplary of a particularly useful application of the present invention wherein the continuous, automatic production of pillow tick products incorporating bound piping is made possible. Many other uses of the invention will be realized in the textile processing and manufacturing industry such as in separating superposed fabric layers along their width for the purpose of directing the layers to separate downstream processes. In this case, the apparatus 20 need only be widened to accommodate the layers, and additional channels and air inlets provided as needed.

Although a particular embodiment of the present invention has been described in the foregoing detailed description, it will be appreciated by those of ordinary skill in the art that the invention is capable of numerous rearrangements, modifications and substitutions of parts without departing from the scope of the invention as set forth in the claims below.

What is claimed:

1. In a system having conveying means supporting and moving superposed fabric layers wherein the fabric layers include a first layer superposed on a second layer, the first and second layers each having leading edges that are substantially aligned, an apparatus for separating the moving superposed fabric layers, comprising:

means defining spaced-apart, opposed first and second surfaces disposed to face the first and second layers of fabric, respectively;

jet means for directing streams of gaseous fluid along each of said first and second surfaces generally in the direction of movement of the superposed fabric layers, said stream of gaseous fluid interacting with said surfaces to produce a vacuum between said first and second surfaces and the first and second layers, respectively, of the superposed layers so that the layers are separated at their leading edges as they are conveyed between the first and second surfaces, said streams of gases fluid imparting a force on the moving superposed layers as they are conveyed between the first and second surfaces so that the layers are urged and translated generally in the direction in which they are being conveyed; and means for maintaining the moving layers in a separated condition after separation of the layers has been effected.

2. The apparatus of claim 1, wherein said separation maintaining means comprises a guide member including a projecting edge and upper and lower surfaces converging at said projecting edge, said guide member being disposed so that just after separation of the leading edges of the fabric layers is achieved, the leading edge of the first layer moves onto said upper surface of said guide member and the leading edge of the second layer moves adjacent the lower surface of said guide member with said projecting edge of said guide member between the layers.

3. The apparatus of claims 1 or 2, wherein each of said first and second surfaces comprises:

a first portion disposed substantially parallel to the direction of movement of the fabric layers; and a second portion extending from said first portion in the direction of movement of the fabric layers and in an outwardly inclined relationship thereto.

4. The apparatus of claim 3, wherein said jet means for directing streams of gaseous fluid along said first and second surfaces is configured to introduce said streams along said first portions in the direction of said second portions substantially parallel to said first portions and at a sufficient velocity so that said stream flowing from said first portions to said second portions create a vacuum between said first and second surfaces and the first and second fabric layers, respectively, said vacuum being of sufficient magnitude to effect the desired separation.

5. The apparatus of claim 4, further comprising smooth rounded portions extending between said first and second portions and generally across the width of said first and second surfaces whereby turbulence in the streams flowing from said first portions to said second portions is minimized.

6. The apparatus of claim 5, wherein said jet means is configured so that said streams flow along said first portions toward said rounded portions and, in cross section, are relatively thin in proportion to their width.

7. The apparatus of claim 4 wherein said jet means is configured so that said streams flow along said first portions toward said second portions and, in cross section, are relatively thin in proportion to their width.

8. The apparatus of claim 4, wherein said jet means comprises passageways formed in each of said first and second surfaces having exit openings located adjacent said first portions of said first and second surfaces and configured so that fluid exits said exit openings along said first portions and substantially parallel thereto and means for introducing compressed air into said passageways and for adjusting the amount of air introduced to achieve the desired separation.

9. An apparatus for separating a pair of moving superposed fabric layers wherein the superposed layers have substantially aligned leading edges extending generally across their width and an top and a bottom surface, comprising:

a downwardly facing surface disposed a predetermined distance above the top surface of the moving layers;

an upwardly facing surface disposed a predetermined distance below the bottom surface of the moving layers, whereby the moving superposed fabric layers are between said downwardly and upwardly facing surfaces;

each of said downwardly and upwardly facing surfaces having a first substantially planar portion disposed substantially parallel to the direction of movement of the layers, a second substantally planar portion extending from adjacent said first planar portion in the direction of movement of the layers and in an outwardly inclined relationship thereto, and a smooth rounded portion between said first and second portions extending generally across the width of the surfaces;

first jet means for jetting streams of gaseous fluid along said first planar portion of said downwardly facing surface substantially parallel thereto and in the direction of said second portion so that the streams flow over said smooth rounded portion and along said second portion and create a vacuum between said downwardly facing surface and the top surface of the moving superposed fabric layers;

second jet means for jetting streams of gaseous fluid along said first planar portion of said upwardly facing surface substantially parallel thereto and in the direction of said second portion so that the streams flow over said smooth rounded portion and along said second portion and create a vacuum between said upwardly facing surface and the bottom surface of the moving superposed fabric layers;

means for adjusting the flow of gaseous fluid through said first and second jet means so that the vacuums created are of sufficient magnitude to effect a separation of at least a portion of the leading edges of the layers as the layers are moved between said downwardly and upwardly facing surfaces and the flow of gas is sufficient to urge and translate the leading edges generally in the direction of movement of the fabric layers to maintain the fabric layers in a generally planar configuration as they are separated; and means for maintaining the layers in a separated condition.

* * * * *